US005368084A

United States Patent [19]

Hying et al.

[11] Patent Number: 5,368,084

[45] Date of Patent: Nov. 29, 1994

[54] BREAKAWAY ROLL-UP DOOR

[75] Inventors: Clement F. Hying, Menomonee Falls; Randy R. Schickert, Kewaskum; Gregory Hahn, Milwaukee, all of Wis.

[73] Assignee: ASI Technologies, Inc., Milwaukee, Wis.

[21] Appl. No.: 169,837

[22] Filed: Dec. 17, 1993

Related U.S. Application Data

[63] Continuation of Ser. No. 934,586, Aug. 24, 1992, Pat. No. 5,299,617, which is a continuation-in-part of Ser. No. 646,532, Jan. 25, 1991, Pat. No. 5,141,044.

[51] Int. Cl.[5] ..... E06B 9/17

[52] U.S. Cl. ..... 160/265; 160/271; 160/291; 160/310

[58] Field of Search ..... 160/271, 274, 265, 310, 160/319, 267.1, 270, 268.1, 291; 49/26, 27, 28

[56] References Cited

U.S. PATENT DOCUMENTS

| | | | |
|---|---|---|---|
| 3,466,805 | 9/1969 | Muessel . | |
| 3,878,879 | 4/1975 | Manns . | |
| 4,478,268 | 10/1984 | Palmer . | |
| 4,997,022 | 3/1991 | Klein | 160/265 |
| 5,025,847 | 6/1991 | Mueller | 160/270 |
| 5,048,588 | 10/1991 | Weishar et al. | 160/265 |
| 5,056,579 | 10/1991 | Krafutler | 160/271 |
| 5,058,651 | 10/1991 | Ashley et al. | 160/271 |
| 5,129,442 | 7/1992 | Warner | 160/310 |
| 5,139,074 | 8/1992 | Warner | 160/310 |
| 5,141,044 | 8/1992 | Hying et al. | 160/271 |
| 5,222,541 | 6/1993 | Hornberger | 160/265 |
| 5,299,617 | 4/1994 | Hying et al. . | |

FOREIGN PATENT DOCUMENTS 2016066 9/1979 United Kingdom .

OTHER PUBLICATIONS

"Rytec Breaks Away!" Advertising Copright 1990.
Rytec Fast-Seal Product Brochure (Undated).
Albany International Rapid Roll Style 410 Product Brochure (1990 New Model Introduction).

*Primary Examiner*—Blair M. Johnson
*Attorney, Agent, or Firm*—Quarles & Brady

[57] ABSTRACT

A roll-up door has a bottom bar attached to the flexible curtain of the door. The bottom bar has transverse openings at each end adjacent to the jambs of the door frame. A breakaway shaft travels in a track in each jamb and has one end normally seated in a respective transverse opening by the interaction of spring loaded ball detents and detent recesses in the shaft and bar. The opposite ends of the shafts are connected to a counterforce mechanism that urges the shaft downwardly and are also connected to a strap wound with the curtain drum to urge the shafts upwardly against the counterforce. The breakaway shafts will separate from the bar upon impact to free the bar from engagement with the jamb and prevent damage to the door. The breakaway shafts may then be reconnected with the bottom bar and reset by unwinding the curtain to an overtravel position that is beyond the normal closed position of the door. A counterforce mechanism is also disclosed in which a counterweight balances the weight of the curtain on the drum and a spring attached between the counterweight and a tension line connected to the breakaway shaft holds the curtain taut.

10 Claims, 6 Drawing Sheets

NORMAL

DISCONNECT SWITCH OPEN

DISCONNECT SWITCH RESTORED

MANUAL RESET

FIG. 8
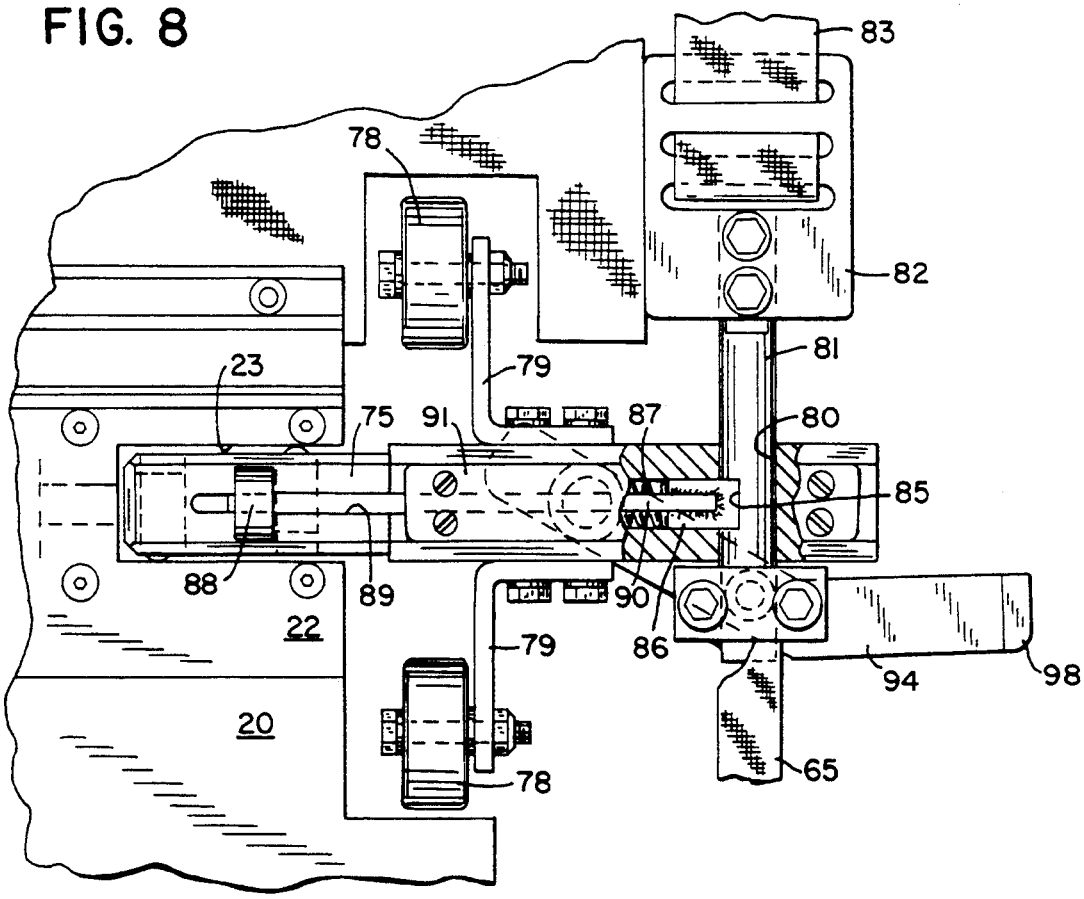
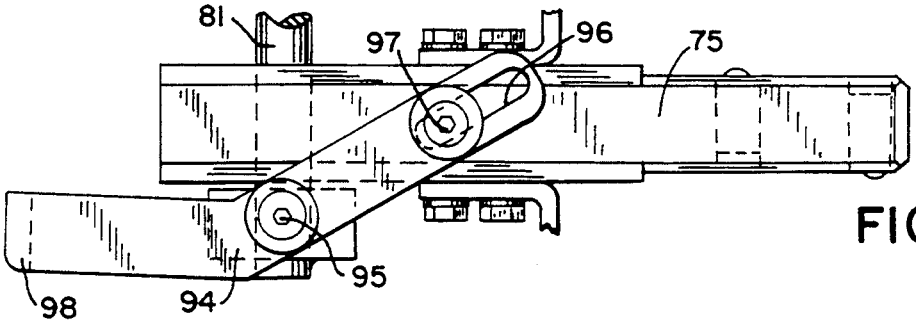
FIG. 9
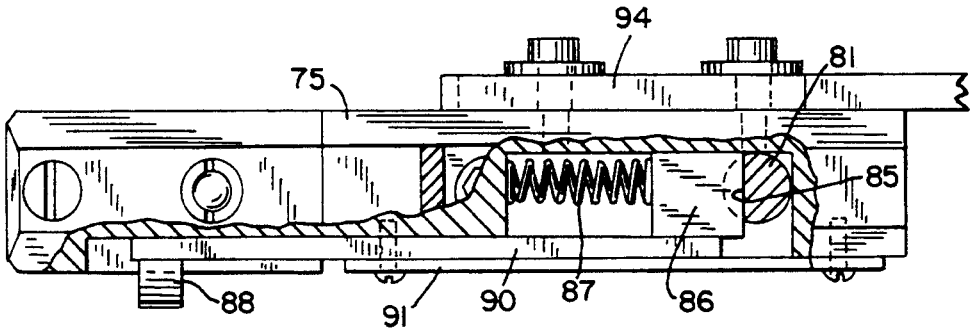
FIG. 10

BREAKAWAY ROLL-UP DOOR

This is a continuation of application Ser. No. 07/934,586, U.S. Pat. No. 5,299,617 filed Aug. 24, 1992, which is a continuation-in-part of application Ser. No. 07/646,532 filed Jan. 25, 1991, which issued on Aug. 25, 1992, as U.S. Pat. No. 5,141,044.

This invention relates to roll-up doors, and particularly to a roll-up door having a mechanism that will release the bottom of the door from its mountings upon impact against the door and which is a readily returnable to an operating condition after impact.

Roll-up doors are widely used in industry to close off sections of factories or warehouses or to seal a doorway of such a facility that leads to the outside. The doors are typically formed with a flexible fabric curtain or a series of interconnected horizontal slats which together form a flexible curtain. The curtain is usually wound about a drum at its upper end, and a bottom bar extends across the lower free end of the curtain. The lateral sides of the bottom bar typically travel in tracks or channels provided in side jambs or columns forming the frame of the door opening. The curtain drum is powered to roll-up and to unwind the curtain. A counterforce mechanism using either a counterweight or tension springs exerts a force against the bottom bar to maintain the curtain taut.

The roll-up industrial doors are designed to operate very quickly and usually automatically upon the approach of a vehicle to either side of the closed door. However, it happens that the door may not be fully open before a vehicle enters the doorway with the result that the curtain or the bottom bar or both may be struck by the vehicle. This can result in severe damage to the curtain, to the bottom bar, or to the frame, effectively making the door unusable until damaged parts are replaced.

A need exists for a roll-up door that will react to an impact against the curtain or bottom bar by yielding to the force without damaging parts and which can be quickly returned to operating condition. Previous attempts to achieve a breakaway roll-up door have relied upon a friction fit of parts that may not release when the curtain or bottom bar are struck with a force that is not wholly normal to the plane of the curtain. Also, previous attempts have required extensive and time consuming efforts to prepare the door for reuse.

A need also exists for a mechanism that not only counters the weight of the door curtain but also tensions the unrolled curtain to hold it taut in the closed position against wind loads or other sources of pressure differential.

SUMMARY OF THE INVENTION

This invention provides a roll-up door in which the bottom bar that is attached to the flexible door curtain has at least one transverse opening at an end adjacent to a jamb of the frame of the door. A breakaway shaft travels in a track in the jamb and has one end that normally seats in the transverse opening and provides a link between the bottom bar and the jamb. The other end of the shaft is restrained so that the shaft is held in a generally horizontal attitude. The opening in the bar and the breakaway shaft have cooperating means to normally retain the shaft in the opening but which are releasable upon a force striking the curtain or bottom bar. The breakaway shaft will separate from the bar upon impact thereby freeing the bar from engagement with the jamb and preventing damage. The breakaway shaft may thereafter be reinserted into the opening in the bar to reconnect the bottom bar to the track and permit continued operation of the door.

The invention further includes a provision for halting the operation of the door upon impact through the use of a switch actuator mounted in the opening in the bar and normally engageable by the breakaway shaft. The actuator is released when the shaft leaves the opening to thereby disable the drive for rolling and unrolling the curtain.

The invention further resides in an improved mechanism for tensioning the door curtain to maintain the curtain taut when subjected to wind loads or other sources of differential pressure.

The improved tensioning mechanism includes a sheave mounted to rotate with the drum on which the door curtain is wound. A counterweight line is anchored at one end and is wound about the sheave in a direction opposite to the winding of the door curtain on the drum. A counterweight is suspended from the counterweight line. A tensioning line is anchored at one end and attached to the breakaway shaft at its other end. A spring connects the counterweight and the tensioning line. Preferably, the diameter of the sheave is greater than the diameter of the drum, or the counterweight line is a strap that is spirally wound on the sheave and has a thickness greater than the thickness of the door curtain, or both.

In a preferred embodiment of the invention, a transverse opening and breakaway shaft are provided on both ends of the bottom bar. The breakaway shafts mount sleeves that ride in the tracks in the jambs. The breakaway shafts mount adjustable ball detents that are received in detent recesses provided in the openings. The opposite ends of the breakaway shafts are connected to a counterforce mechanism that urges the shaft, and thereby the bottom bar, downwardly. The opposite ends of the breakaway shafts are also each connected to a strap that is wound with the curtain drum to urge the opposite ends of the breakaway shafts upwardly against the counterforce.

In a second preferred embodiment, the breakaway shafts have their opposite ends slidably engaged on a vertical rod disposed in each jamb. The rods are connected at their top to the straps that are wound with the drum. The rods are connected at their bottom to a tensioning line that is part of the counterforce mechanism and urges the rods downwardly. The shafts each include a spring loaded, manually releasable latch that engages a catch in the respective rod to join the shaft to the rod. After the shaft has broken away from the bottom bar, the latch can be released to allow the shaft to be moved vertically for reinsertion in the transverse opening. Each rod also mounts a pivoting lever that is linked to the shaft. When the curtain is driven downwardly to an overtravel position following the reinsertion of the shaft into the bottom bar, the lever will engage a stop and move the shaft to engage the latch with the catch.

It is a principal object of the invention to provide a roll-up door that will release from its track upon being struck by a force having a component normal to the plane of the door without damage to parts of the door.

It is another object of the invention to provide such a roll-up door that is quickly returnable to an operating condition following a release.

It is a further object of the invention to provide such a roll-up door in which the driving of the door is automatically halted when it releases upon impact and cannot be restarted until the released parts are properly reassembled.

It is also an object of the invention to provide a tensioning mechanism that will keep the door curtain very taut when the curtain is closed.

The foregoing and other objects and advantages of the invention will appear from the detailed description that follows. In the description, reference is made to the accompanying drawings which illustrate a preferred embodiment of the invention.

BRIEF DESCRIPTION OF THE DRAWINGS

FIG. 8 is a front view in elevation of the breakaway mechanism on one side of the door of FIG. 6;

FIG. 9 is a partial rear view in elevation of the breakaway mechanism of FIG. 8;

FIG. 10 is a top view, partially in section, of the breakaway mechanism of FIG. 8;

DETAILED DESCRIPTION OF THE PREFERRED EMBODIMENTS

Figure 2:
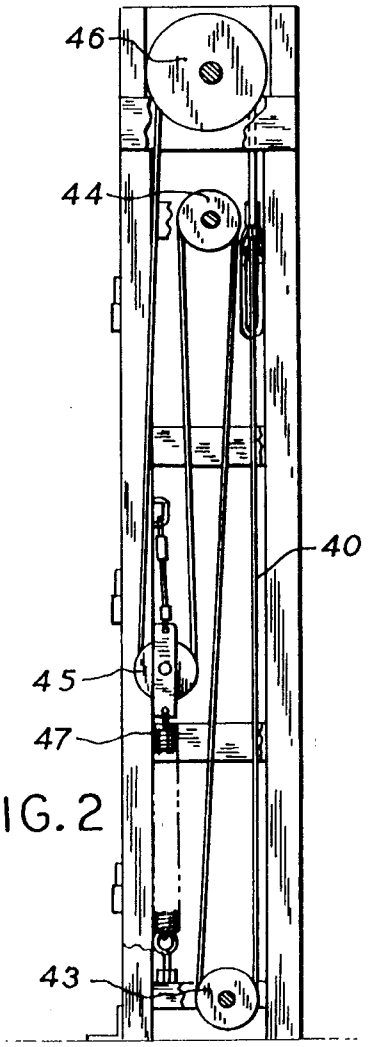
FIG. 2 is a side view of the door of FIG. 1.
Figure 1:
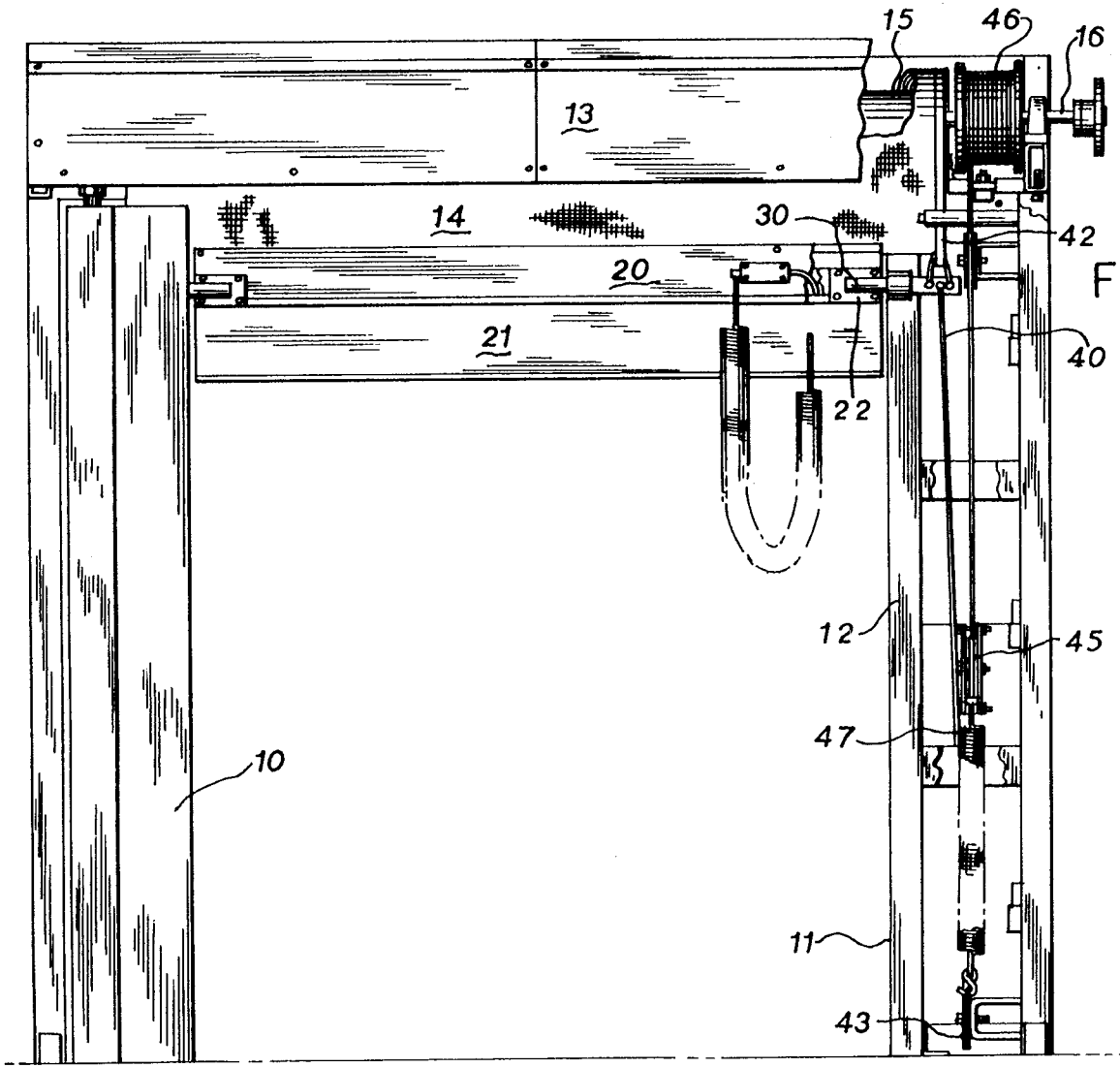
FIG. 1 is a front view in elevation, and partially in section, of a roll-up door in accordance with the invention.

Referring to FIGS. 1—4, the roll-up door includes a frame formed of side channel assemblies or jambs 10 and 11 each of which includes a vertical track 12 defined by spaced elements. The frame is completed by a horizontal header 13 that spans the jambs 10 and 11. A flexible fabric curtain 14 is wound about a drum 15 mounted on a powered shaft 16. The shaft 16 may be driven by a drive such as that illustrated in U.S. Pat. No. 4,941,320 issued Jul. 17, 1990 for "Industrial Hydraulic Door Operator" and assigned to the assignee of this application. The lateral side edges of the fabric curtain 14 are loosely received in the tracks 12 in the jambs 10 and 11.

A metal bottom bar 20 is mounted to the lower free end of the curtain 14. The bottom bar 20 includes an elastomer reversing edge 21 along its bottom that responds to the compression of pockets in edge 21 if the curtain 14 encounters an obstruction as it is attempted to be lowered, in a known manner. The bottom bar 20 is provided with transverse openings at each ends. The openings are defined in a pair of receptacle blocks 22 each of which defines a U-shaped opening 23 that extends through the plane of the curtain 14 and which opens outwardly towards a respective jamb. Each receptacle block 22 mounts a pair of laterally spaced detent recess members 24 and 25 in the top and bottom of the opening 23, respectively.

Breakaway shafts 30 mount nylon friction sleeves 31 intermediate to the shaft ends and the friction sleeves 31 travel in the tracks 12. One end 32 of each breakaway shaft 30 is adapted to be received in a corresponding opening 23 in the end of the bottom bar 20. This end 32 of the shaft 30 mounts a pair of ball detents 33 and 34 that are adapted to be received in the detent recess members 24 and 25, respectively, of a receptacle block 22. When the breakaway shaft 30 is positioned with its first en 32 within the opening 23 in the receptacle block 22, an actuator 35 of a disconnect switch 36 is engaged by the breakaway shaft 30.

Figure 3:
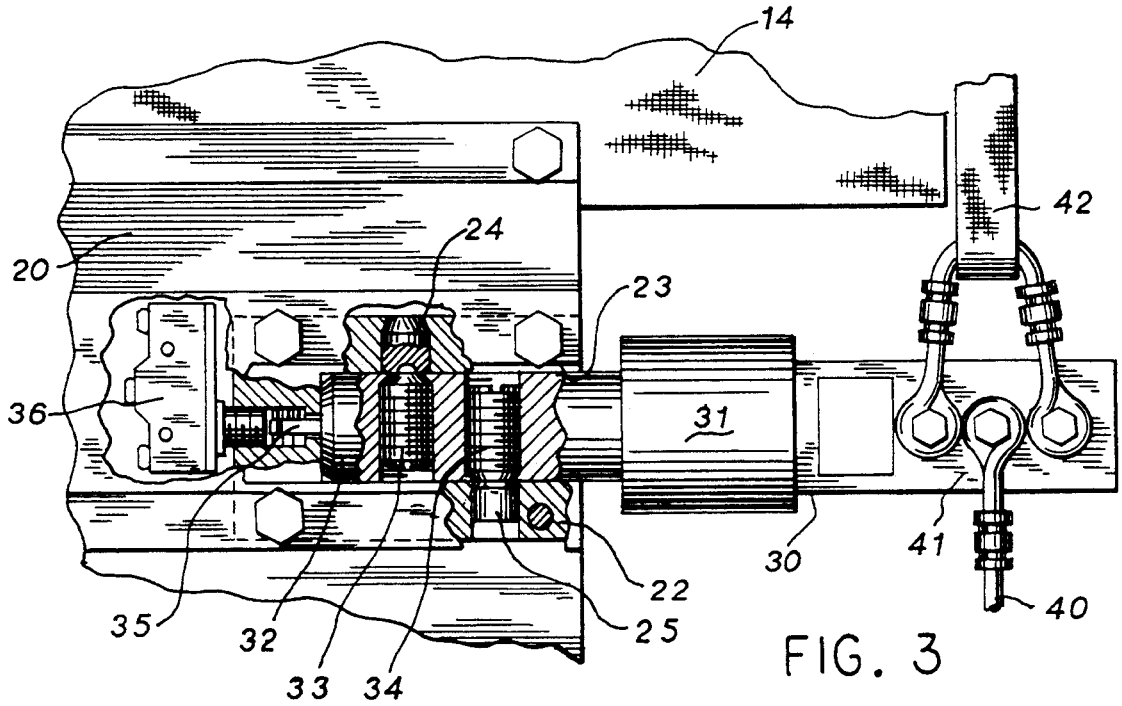
FIG. 3 is an enlarged view in elevation of the breakaway mechanism of the present invention.
Figure 4:
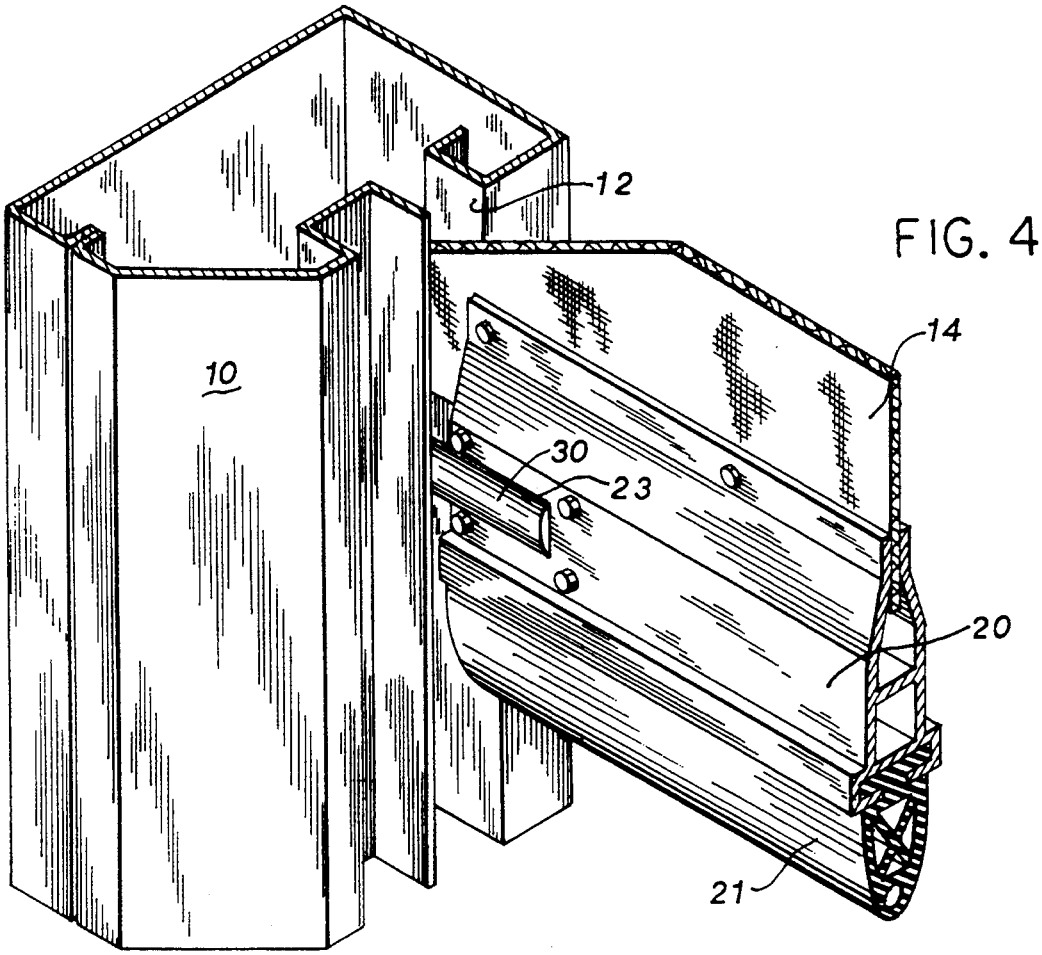
FIG. 4 is a view in perspective of the breakaway mechanism in relation to one of the jambs of the door frame.

As shown in FIG. 3, the detent recess members 24 and 25 are fitted into openings in opposite sides of the receptacle block 22. The recess members each include a hemispherical recess that is adapted to receive the ball of a respective ball detent 33 and 34. In a known manner, the balls of the ball detents are mounted in and captured by a detent body that is externally threaded and received in a threaded cross-bore in the one end 32 of the shaft 30. The balls are biased outwardly of the body by internal springs. By changing the position of the body within the threaded cross-bores, the extent that the balls enter the detent recesses can be adjusted and the force required to dislodge a ball from a ball recess can thereby be adjusted.

When the breakaway shafts 30 are in place in the openings 23 in the bottom bar 20, the shafts 30 connect the bottom bar to the jambs 10 and 11 so that the curtain 14 will travel in the proper plane while the curtain moves up and down as the door is opened and closed. However, should the curtain 14 or bottom bar 20 be struck by a vehicle or any other source of significant force, the breakaway shafts 30 will unseat from the openings 23 in the bottom bar 20 and the bottom bar 20 will be released from its connection with the jambs 10 and 11 so that the curtain 14 and bottom bar 20 can absorb the force without damage to any of the parts of the door. When a collision occurs, one or both of the disconnect switches 36 will also be opened by reason of the actuators 35 no longer being engaged by the breakaway shafts 30. This will cut power to the circuit for the drive motor thereby stopping the curtain in the position in which it is when the collision occurs.

To return the door to an operating condition involves the simple task of re-engaging the breakaway shafts 30 with the respective openings 23 in the bottom bar 20 and tucking the edges of the curtain 14 into the tracks 12 in the jambs 10 and 11. A reset switch 38 may also be provided which is required to be manually activated after the disconnect switches 36 have again been closed by engagement of their actuators 35 with the breakaway shafts 30. The reset switch 38 will re-energize the circuit to the drive motor to allow the door to continue in its normal operation.

A schematic diagram of a cutout circuit for disabling door motion in response to opening of either of the disconnect switches 36 is shown in FIGS. 5*a–d*. The circuit is connected to a control voltage source 40 suitable for operation of a cutout relay 41. A first set of contacts 41*a* on the cutout relay 41 are provided for enabling a conventional motor control circuit (not shown). For example, a three phase, reversing motor control circuit as shown in U.S. Pat. No. 4,941,320 may be modified as would be apparent to those skilled in the art to be enabled by the contacts 41*a*.

Figure 5A:
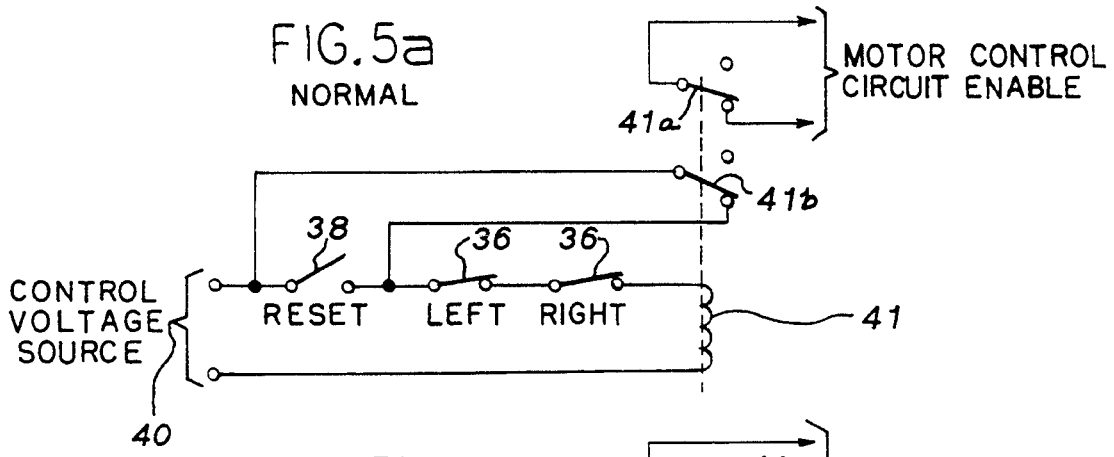
FIGS. 5*a–d* are partial circuit diagrams of the control of the motor drive of the door illustrating different states of operation.

In FIG. 5*a*, the cutout circuit is shown in a normal configuration, with the cutout relay 41 electrically held in by current flowing from the control voltage source 40 through a series connection of a second set of contacts 41*b* on the cutout relay 41 and both normally closed door disconnect switches 36. As long as the door disconnect switches 36 both remain closed (i.e. with their respective mechanisms not broken away), the motor control circuit remains enabled, and the door operates normally.

Figure 5B:
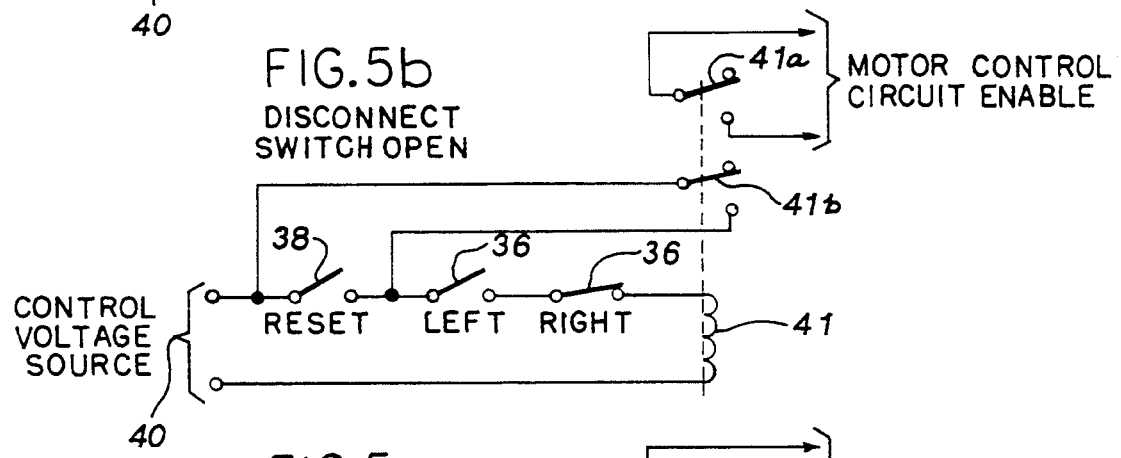

As shown in FIG. 5*b*, if either of the disconnect switches 36 are opened, due to breakaway of the respective mechanism, current to the cutout relay 41 is interrupted, and the cutout relay 41 drops out. Dropping out of the cutout relay 41 causes contacts 41a to open, disabling the motor control circuit. Contacts 41*b* on the cutout relay 41 are also opened by the dropping out of the cutout relay. As a result, once the cutout relay is dropped out, reclosing of the disconnect switches 36 will not effect pulling in of the cutout relay 41. Instead, the reset switch 38 must be manually depressed following a breakaway event, to pull in the cutout relay 41 and restore normal circuit operation.

Figure 5C:
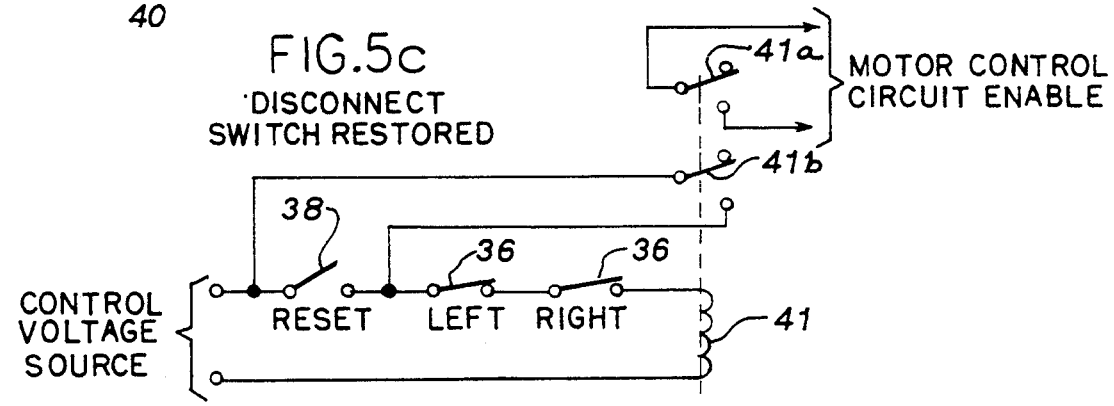
Figure 5D:
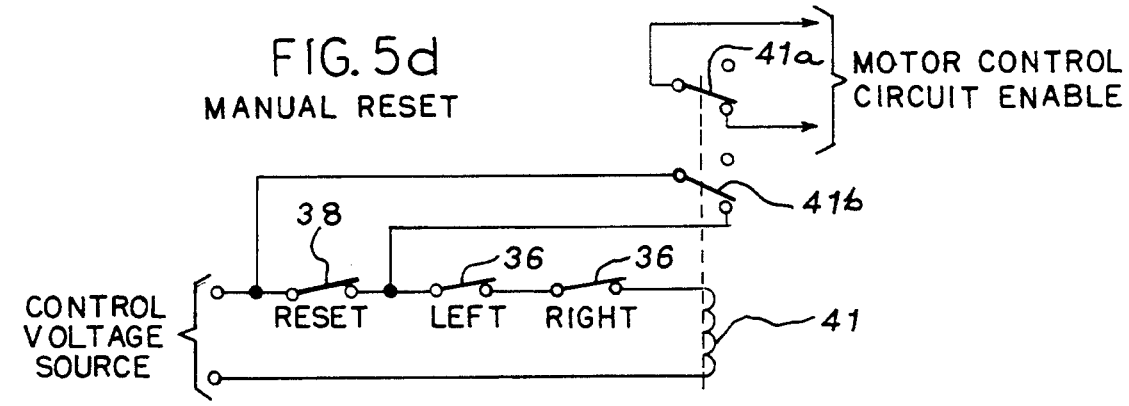

As specifically illustrated in FIG. 5*c*, both disconnect switches 36 have been restored to the normal closed position following a breakaway event, but the cutout relay 41 remains dropped out due to the open circuit across contacts 41*b*. However, when the reset switch 38 is manually activated as shown in FIG. 5*d*, current flows directly through the reset switch 38 and the disconnect switches 36 to pull in the cutout relay 41. Once the cutout relay 41 is pulled in, the reset switch 38 may be released, and the cutout relay remains electrically held in by current through contacts 41*b* and the disconnect switches 36 (i.e. back to the configuration of FIG. 5*a*.)

It should be noted that a power interruption to the cutout circuit will have the same effect as opening one of the disconnect switches 36. Manual depression of the reset switch 38 is therefore required after a power interruption. Also, depression of the reset switch 38 prior to restoring the disconnect switches 36 to the normally closed position will have no effect on pulling in the cutout relay 41 or energizing the motor control circuit. If either of the disconnect switches 36 remains open, cutout relay 41 remains dropped out and the motor control circuit remains disabled.

Minimal effort is required to reposition the breakaway shafts 30 within the openings in the bottom bar because the breakaway shafts are held in a proper horizontal position within the tracks 12, both horizontally and vertically, even after they are released from the bottom bar 20. This proper positioning is accomplished by a cable or strap 40 attached to an opposite end 41 of each breakaway shaft 30 and urging the shaft downwardly, and a retaining strap 42 also connected to the opposite end 41 of the shaft 30 and wound about the drum 15 at a lateral edge of the curtain 14 and urging the shaft upwardly. The cable 40 is connected about a lower pulley 43, an upper pulley 44, a spring pulley 45, and about a cable drum 46 which rotates with the curtain drum 15. The spring pulley 45 is attached to the free end of a tension spring 47. The cable 40 and spring 47 provide a counterweight force which tends to pull the shaft 30 downwardly. When the shafts 30 are connected to the bottom bar 20, the cable 40 and spring 47 will maintain the curtain 14 taut. The combination of the forces exerted by the strap 42 and cable 40 will hold each breakaway shaft 30 in a generally horizontal position in the track 12 even when it is disconnected from the bottom bar 20, and will also hold the shaft in the vertical position that it occupied when released from the bottom bar.

The force exerted by the ball detents 33 and 34 is adjustable by adjusting the position of the set screws behind the detents. Thus, the force necessary to cause release of the breakaway shafts 30 is adjustable.

The release of the bottom bar 20 from the breakaway shafts 30 is not dependent upon the direction from which a force strikes the curtain or bottom bar, so long as that force is not wholly vertical. Any sufficient force having a component that is normal to the plane of the curtain 14 or bottom bar 20 will release the breakaway shafts 30 because the shafts are each held in an opening 23 at only two spaced points of contact.

Although the invention is shown in relation to a door including a fabric curtain 14 of continuous construction, it can also be applied to other forms of roll-up doors such as those formed of interlocking or joined horizontal slats. Also, the ball detents and detent recesses may be reversed between the breakaway shaft 30 and bottom bar opening 23 such that the detents would be mounted in the receptacle block 22 and the detent recesses would be mounted in the shaft 30. Furthermore, more than two sets of detents and detent recesses may be provided in each opening 23 and shaft 30.

The drive for a roll-up door curtain is subjected to considerable stress in the form of moments or torque loads resulting from the weight of the door curtain hanging off the radius of the drum on which it is wound. The moment experienced by the drive varies as the curtain is rolled onto the drum due to the decrease in the overhanging weight of the curtain and the increase in moment arm. This change is not constant or linear. Typically, a weight or spring is attached to act on the opposite side of the drum to apply a moment to cancel the moment produced by the curtain. A simple spring or weight arrangement can work for a basic door system if there is no requirement for tension in the door curtain. Tension in the curtain reduces the effect of pressure differentials through the door opening and better controls the rolling of the curtain onto the drum. Tension can be achieved by attaching a spring to the bottom end of the curtain through a mechanism that extends the spring as the curtain is closed. However, such a tension force works against the counterbalance force for the drum which must increase as the door closes.

Figure 6:
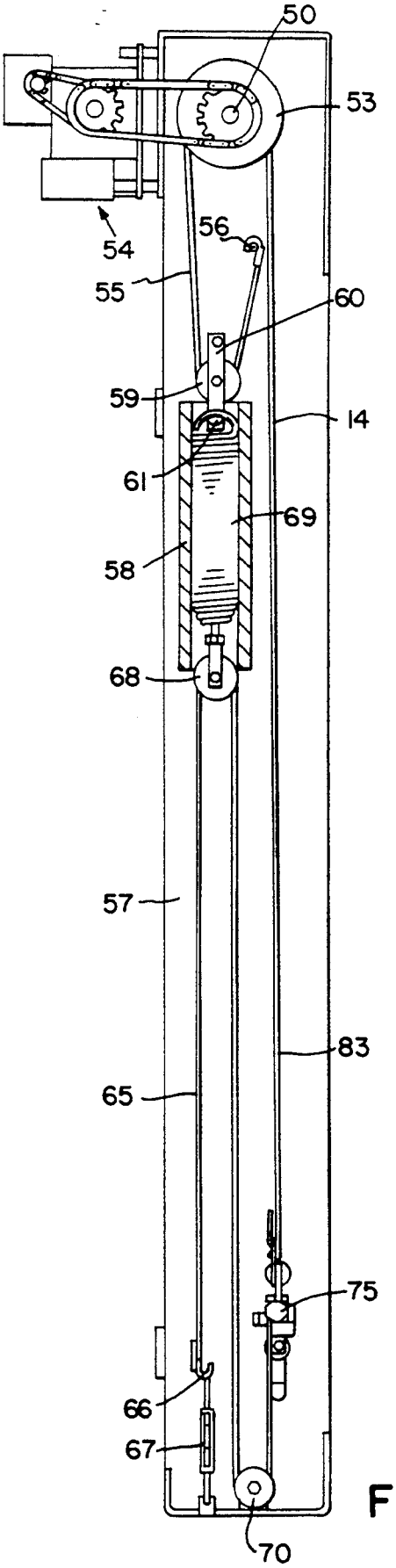
FIG. 6 is a side view of a door having an improved counterbalance and tensioning mechanism, and an alternate embodiment of a breakaway mechanism.
Figure 7:
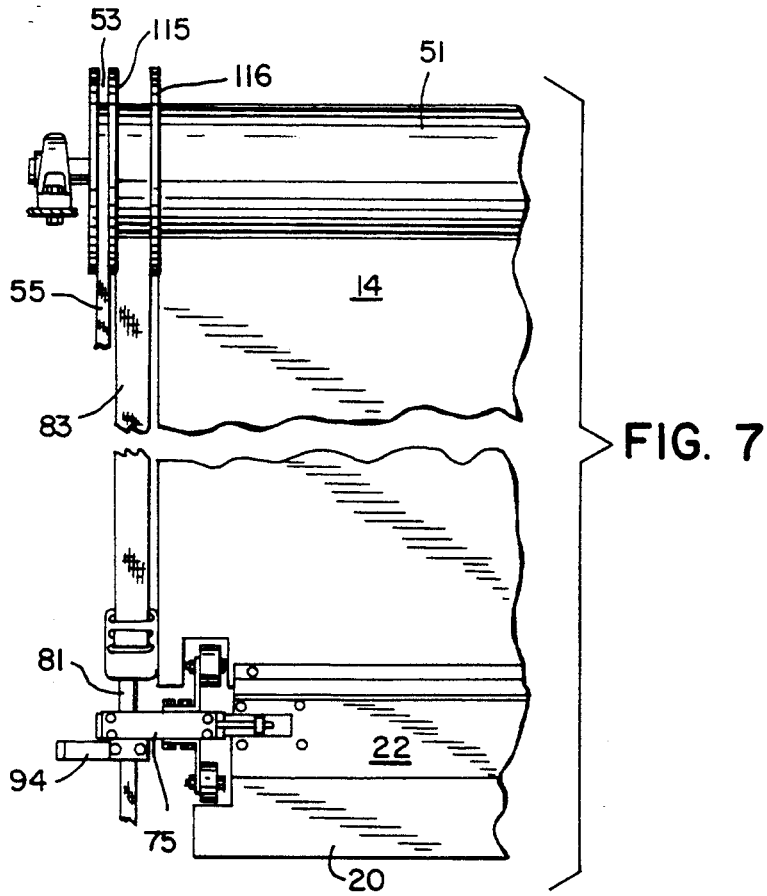
FIG. 7 is a foreshortened front view of the mechanism of FIG. 6.

An improved counterweight and tensioning system is shown in FIGS. 6 and 7 The powered shaft 50 that mounts the drum 51 upon which the flexible fabric curtain 14 is wound, also supports sheaves 53 outboard of each end of the drum 51. The shaft 50 is driven by a drive 54 of known construction. A counterweight line 55 in the form of a strap is anchored at one end 56 to the inside of a jam 57. The other end of the counterweight strap 55 is mounted in a single spiraling layer about a sheave 53. The strap 55 is wound about the sheave 53 in a direction opposite to the winding of the curtain 14 on the drum 51. A counterweight 58 is suspended from the counterweight strap 55 by means of a pulley 59 supported by a bracket 60 that is connected to a crossbar 61 within the counterweight 58. The weight of the counterweight 58 tends to counter the weight of the fabric curtain 14 extending from the drum 51.

A tensioning line 65 also in the form of a strap, is anchored at one end 66 to a turnbuckle 67 mounted in the jamb 57. The tensioning line 65 extends over a pulley 68 that is connected to one end of a coiled tension spring 69. The opposite end of the spring 69 is attached to the counterweight 58 at the crossbar 61. The tensioning line 65 extends from the spring pulley 68 down to a stationary pulley 70 at the bottom of the jamb and then upwardly to connect to a breakaway shaft mechanism to be described. The tensioning line 65 will tend to pull the bottom bar 20 of the curtain 14 downwardly. A like arrangement of counterweight 58, tension spring 69, and lines 55 and 65 is disposed in the opposite jamb.

The purpose of the counterweight and tensioning mechanism is to match as nearly as possible the forces on the drive 54 as the curtain 14 is wound and unwound from the drum 51, while at the same time increasing the tension on the curtain 14 as it is unwound towards a closed position of the door. Both functions may be accomplished by providing a greater diameter for the counterweight sheave 53 than the diameter of the drum 51, or by providing a greater thickness for the counterweight strap 55 compared to the thickness of the fabric curtain 14, or a combination of both. As an alternative, a spiral cable drum of known construction could be used. This will result in the effective diameter of the drum with curtain being less than that of the counterweight sheave 53. The portion of the counterweight strap between the anchor 56 and the pulley 59 will therefor lag behind the distance on the strap between the pulley 59 and the sheave 53. This will create a net loss as the door fabric is closed. This net loss stretches the spring 69 as the door closes thereby increasing the tension on the door and holding the fabric curtain 14 more taut. In summary, the counterweight 58 balances the system so that the size of the drive 54 can be minimized and the tensioning spring 69 adds more tension to the door fabric as the door is closed. A combination of the counterweight and the tensioning spring provides a mechanism that balances the load on the operator while at the same time varies the tension relative to door position.

The alternate breakaway mechanism usable with the improved counterbalance and tensioning mechanism employs breakaway shafts 75 that are similar to the breakaway shafts 30 of the first embodiment in that the breakaway shafts 75 of the second embodiment each mount a pair of spring loaded ball detents 76 and 77 that are received in the detent recesses in the respective opening 23 in the receptacle block 22. When in place within the opening 23, the breakaway shafts 75 will each engage the actuator 35 (not shown) of a disconnect switch 36 as in the first embodiment. The breakaway shafts 75 have vertically spaced rollers 78 that are each mounted on L brackets 79 extending from the top and bottom of the breakaway bar 75. The rollers ride in the vertical tracks 12. The opposite end of each breakaway shaft 75 includes a transverse opening through which a vertical rod 81 extends. The vertical rod 81 is located in the jamb and mounts a strap buckle 82 at its upper end. The strap buckle 82 engages one end of a retaining strap 83 similar to the strap 42 of the first embodiment. The retaining strap 83 is wound about the drum 51 at an end of the drum. The bottom of the rod 81 is connected to the opposite end of the tensioning line 65.

The vertical rod 81 is provided with a catch in the form of a rectangular notch 85 at one position along its length. The breakaway bar 75 mounts an internal spring loaded latch that includes a block 86 that is adapted to fit within the notch 85 and which is urged to such a position by a compression spring 87. A manually engageable handle 88 extends outwardly from a longitudinal slot 89 provided in the breakaway bar 75 and is connected to the block 86 by a bar 90. By grasping the handle 88 and compressing the spring 87, the block 86 can be released from the catch notch 85. This allows the breakaway bar to slide vertically upon the rod 81. A side plate 91 closes off the slot 89 and the chamber within the breakaway bar that holds the spring 87 and block 86.

The breakaway bar 75 normally is latched to the vertical rod 81 and functions as a unit with the vertical rod 81 and the retaining and tensioning straps 83 and 65. The breakaway bar 75 will function in the same manner as the breakaway bar 30 of the first embodiment if the curtain or bottom bar are struck with a force having a component normal to the surface of the curtain or bar. In the event that the breakaway bar 75 releases from its connection with the bottom bar 20, the breakaway bar 75 will continue to be subjected to the high tension forces by the improved counterbalance and tensioning mechanism. Since the fabric curtain will no longer be subjected to those same tensioning forces, the disconnected breakaway bar 75 may no longer line up vertically with the opening 23. The tension on the breakaway bar and vertical rod assembly may be such that it is difficult to re-engage the breakaway bar 75 in the opening 23. However, the tension on the breakaway bar 75 can be removed by manually releasing the latch block 86 from the catch 85 in the vertical rod 81 thereby freeing the breakaway bar from the vertical rod. This allows the breakaway bar 75 to be manually moved vertically on the rod 81 until it is at a vertical position where it can be reinserted in the respective opening 23.

Figure 11:
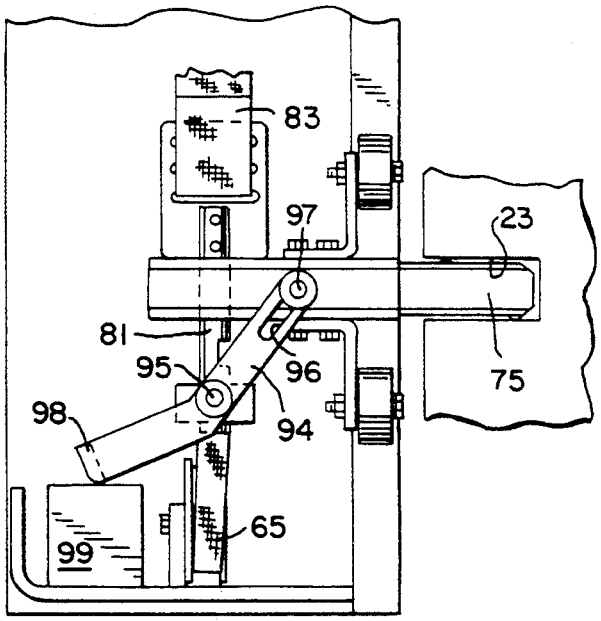
FIGS. 11 and 12 are rear views of the alternate breakaway mechanism illustrating the manner in which the mechanism is reset following breakaway.
Figure 12:
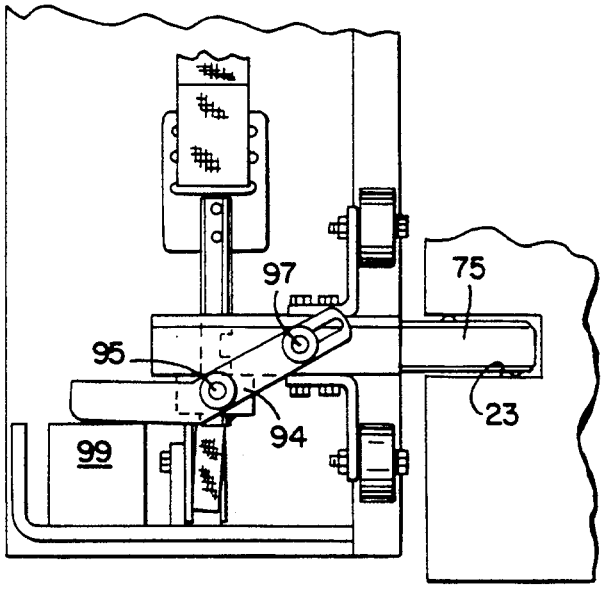

The alternate breakaway bar mechanism also includes a provision for automatically relatching the breakaway shaft 75 onto the vertical rod 81 after it has been manually released. This is accomplished by a lever 94 that is pivotally mounted intermediate its ends on a pivot 95 attached to the rod 81. One end of the lever 94 includes a longitudinal slot 96 that receives a pin 97 extending from the back of the breakaway bar 75. The opposite, free end 98 of the lever 94 is adapted to encounter a stationary stop 99 that rises from the bottom of the jamb 57. As shown in FIGS. 11 and 12, after the breakaway shaft 75 has been reinserted in the opening 23, subsequent movement of the curtain down to its fully closed position will cause the free end 98 of the lever 94 to engage the stop 99 thereby rotating the lever 94. This will cause the pin 97 to be forced down the slot 96 with the result that the entire breakaway shaft 75 will be forced to move down vertically on the rod 81 until the latch re-engages the catch on the rod 81.

Figure 13:
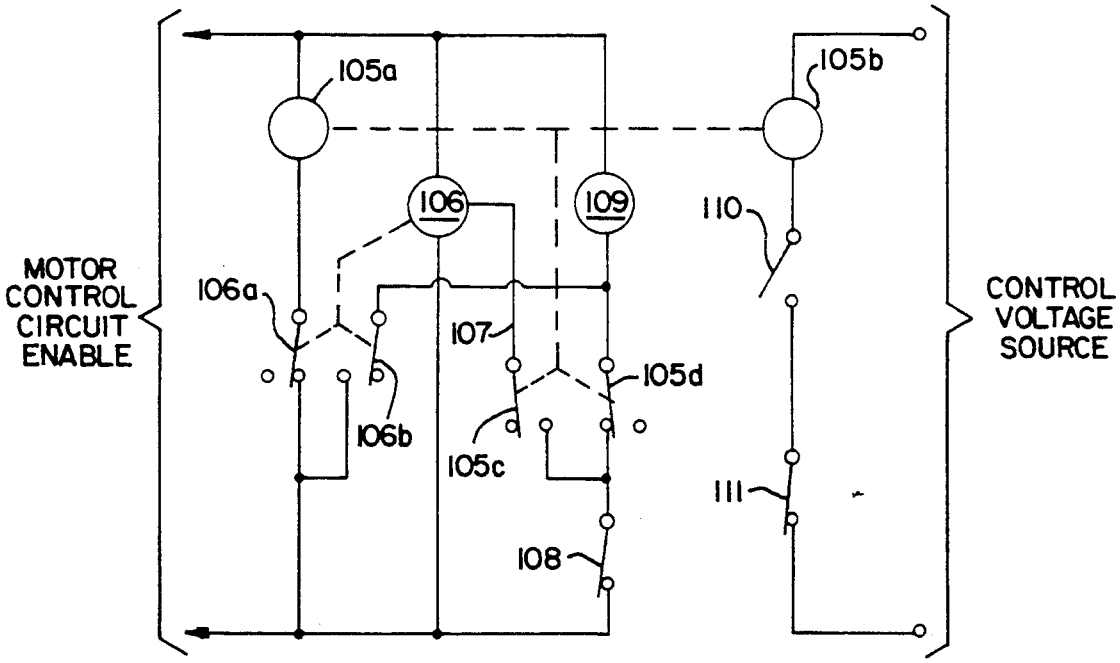
FIG. 13 is a partial circuit diagram of the control of the motor drive of the door having the alternate breakaway mechanism.

Following a breakaway condition and the subsequent re-assembly of the breakaway bar 75 into its respective opening 23, the control circuit will automatically cause the door to be moved to beyond a fully closed position so that the lever 94 can relock the breakaway bar 75 with the rod 81. The circuit to accomplish that activity is shown in FIG. 13. The motor control circuit enable includes a latching relay having a reset coil **105*a*. The reset coil 105*a* is energized through the normally closed contacts 106a of a timing relay 106**. The timing relay 106 has an initiate line 107 that includes normally open contacts 105*c* of the latching relay and a normally closed door closed limit switch 108. The door closed limit switch 108 also is in series with normally closed contacts 105*d* of the latching relay to energize a motor control coil 109 which enables the motor to drive the door downwardly to a closed position. A latching relay set coil 105*b* is energized by a reset switch 110 which may be linked with the reset switch 38 of the first embodiment. When the set coil 105*b* of the latching relay is energized, the circuit to complete the initiate line 107 from the timing relay 106 is completed which will close normally open contacts 106*b* to provide an alternate path to energize the motor control coil 109 thereby causing the motor control coil to drive the motor to close the door. At the same time, the normally closed contacts 106*a* of the timing relay 106 are opened to de-energize the reset coil 105*a* of the latching relay. The energization of the set coil 105*b* and de-energization of the reset coil 105*a* of the latching relay will open the contacts 105*d* connecting the motor control coil 109 through the limit switch 108 so that the limit switch 108 will no longer control the operation of the motor. However, when the limit switch 108 opens indicating that the door has reached its normal bottom position, the initiate line 107 to the timing relay will be opened. The timing relay 106 will time out for a short period of time such as two-tenths of a second to ensure that the door is driven downwardly to an overtravel position beyond the normal bottom position. Only at the overtravel position will the lever 94 engage the stop 99 to relock the breakaway shaft with the vertical rod 81. After the time delay, the reset coil 105*a* again will be energized and the entire circuit will return to normal.

It would be undesirable to allow any of the reset door functions to take place if there was an obstruction in the doorway. Therefore, the function of the manual reset switch 110 cannot function to accomplish a reset unless a further switch 111 is closed. The switch 111 may be connected to sensors or switches that determine the existence of an obstruction in the doorway or some other condition that would make it unsafe to close the door, in a known manner.

As shown in FIG. 7, for purposes of economy, the curtain 51 drum and the counterweight line sheave 53 can be constructed from a single barrel having spacers 115 and 116 to define separate areas for the fabric curtain 14, the counterweight strap 55 and the restraining strap 83. The greater diameter for the portion that defines the sheave 53 can be achieved by wrapping the barrel with additional layers of fabric or strapping.

The present invention provides a high speed roll-up door that can survive a collision without sustaining any damage that is detrimental to door operation. The time to reset the door and have it back in operation is at a minimum thereby providing the user with guaranteed operation even under severe circumstances. Production flow is maintained by not having to wait for repairs.

The embodiments of the invention in which an exclusive property right is claimed are defined as follows:

Wwhat is claimed is:

1. A roll-up door, comprising:

a frame having spaced jambs joined at the top by a header, the jambs each defining elongated tracks;

a drum rotatably mounted in the header;

a flexible curtain wound about the drum and having its lateral edges disposed in the tracks;

a bottom bar attached to the free end of the curtain and extending between the jambs;

a breakaway means releasably attached to the bottom bar at one end of the bar, said means releasing from the bottom bar when the curtain is struck by a force having a component normal to its surface;

a retaining sheave attached to rotate with the drum; and a retaining line attached at one end to the sheave to wind in the same direction as the curtain and with its other end attached to the breakaway means so as to maintain the breakaway means in the position it is in when the breakaway means releases from the bottom bar.

2. A door in accordance with claim 1 wherein the drum is powered.

3. A door in accordance with claim 1 wherein the bottom bar has a traverse opening at one end; and the breakaway means includes a breakaway shaft riding in the track of a respective jamb, said shaft having one end received in the opening in the bar to normally hold the bar to the track, and means for releasably holding the end of the shaft in the opening in the bar, said releasable means releasing the shaft from the bar when the curtain is struck by a force having a component normal to its surface.

4. A door in accordance with claim 3 wherein said bar and shaft have a cooperating detent with detent recess that normally holds the shaft in the bar but which releases when the curtain or bar is struck by a force having a component normal to the surface of the curtain.

5. Roll-up door, comprising:

a frame having spaced jambs joined at the top by a header, the jambs each defining elongated tracks;

a drum rotatably mounted in the header;

a flexible curtain wound about the drum and having its lateral edges disposed in the tracks;

a bottom bar attached to the free end of the curtain and extending between the jambs;

a breakaway means releasably attached to the bottom bar at both ends of the bar, said means releasing from the bottom bar when the curtain is struck by a force having a component normal to its surface;

a retaining sheave mounted at each end of the drum to rotate with the drum; and a retaining line attached at one end to each sheave to wind in the same direction as the curtain and with the other end of the line attached to the breakaway means so as to maintain the breakaway means in the position it is in when the breakaway means releases from the bottom bar.

6. A door in accordance with claim 5 wherein the drum is powered.

7. A door in accordance with claim 5 wherein the bottom bar has a traverse opening at each end; and the breakaway means includes a breakaway shaft riding in the track of a respective jamb, said shaft having one end received in the opening in the bar to normally hold the bar to the track, and means for releasably holding the end of the shaft in the opening in the bar, said releasable means releasing the shaft from the bar when the curtain is struck by force having a component normal to its surface.

8. A door in accordance with claim 7 wherein said bar and shaft have a cooperating detent and detent recess that normally holds the shaft in the bar but which releases when the curtain or bar is struck by a force having a component normal to the surface of the curtain.

9. A roll-up door, comprising:

a frame having spaced jambs joined at the top by a header, the jambs each defining elongated tracks;

a drum disposed in the header;

a flexible curtain wound about the drum at one end;

a bottom bar attached to the free end of the curtain and extending between the jambs, said bar having transverse openings at each end which extend through the plane of the curtain and open towards the respective jamb;

a pair of breakaway shafts each disposed to ride in a respective track and including one end received in the respective opening in the bar to normally hold the bar in the tracks;

means for releasably holding the ends of the shafts in the openings in the bar, said means releasing the shafts from the bar when the curtain is struck by a force having a component normal to its surface; and means attached to second opposite ends of each shaft for maintaining the shafts in a generally horizontal attitude and vertical location even when the shafts are released from the bar.

10. A roll-up door in accordance with claim 9 wherein the means attached to the second opposite end of each shaft includes a counterforce mechanism having cables attached to the second opposite end of each breakaway shaft to urge the breakaway shafts and the bottom bar downwardly, and a flexible strap attached to the second opposite end of each shaft and wound about the drum to urge the shaft upwardly.

* * * * *